US012534870B2

(12) United States Patent
Chartre et al.

(10) Patent No.: US 12,534,870 B2
(45) Date of Patent: Jan. 27, 2026

(54) CUTTER THRUST BEARING ASSEMBLY

(71) Applicant: GREAT LAKES DREDGE & DOCK COMPANY, LLC, Houston, TX (US)

(72) Inventors: Mike Chartre, Watertown, WI (US); Edwin Hahlbeck, Pewaukee, WI (US)

(73) Assignee: Great Lakes Dredge & Dock Company, LLC, Houston, TX (US)

( * ) Notice: Subject to any disclaimer, the term of this patent is extended or adjusted under 35 U.S.C. 154(b) by 868 days.

(21) Appl. No.: 17/847,816

(22) Filed: Jun. 23, 2022

(65) Prior Publication Data

US 2023/0417013 A1 Dec. 28, 2023

(51) Int. Cl.
*E02F 3/92* (2006.01)
*E02F 3/88* (2006.01)

(52) U.S. Cl.
CPC ..... *E02F 3/9225* (2013.01); *E02F 3/8841* (2013.01)

(58) Field of Classification Search
CPC . E02F 3/922; E02F 3/8841; E02F 3/04; E02F 3/18; E02F 3/88; E02F 3/8808; E02F 3/8833; E02F 3/92; E02F 3/9256; E02F 3/9268; E02F 3/9275; E02F 3/9225
USPC .... 37/326, 325, 307, 317, 331, 334; 384/91, 384/93, 107, 108, 590, 606, 609, 615
See application file for complete search history.

(56) References Cited

U.S. PATENT DOCUMENTS 3,763,580 A * 10/1973 Kuntz, Jr. ..... E02F 3/8841 37/321
4,267,652 A * 5/1981 Senesac ..... E02F 3/9237 37/189
4,979,322 A * 12/1990 Sloan ..... E02F 3/9262 405/74
2016/0084017 A1* 3/2016 Finke ..... E21B 3/00 175/73
2020/0240212 A1* 7/2020 von Gynz-Rekowski ..... E21B 7/068
2020/0300042 A1* 9/2020 Peters ..... E21B 7/067

* cited by examiner

*Primary Examiner* — Christopher J Sebesta
*Assistant Examiner* — Evan A Bregel
(74) *Attorney, Agent, or Firm* — Foley & Lardner LLP

(57) ABSTRACT

A cutter suction dredger includes a vessel, a ladder extending away from the vessel, a cutter head positioned at a distal end of the ladder and configured to contact a bed of the body of water to cut into the bed, and a bearing assembly. The bearing assembly includes a first spherical thrust bearing configured to resist thrust forces generated by the cutter head contacting the bed, a second spherical thrust bearing positioned opposite the first spherical thrust bearing, a symmetrical spherical bearing positioned between the first and second spherical thrust bearings, and a housing surrounding the first and second spherical thrust bearings and the symmetrical spherical bearing, the housing mounted to the ladder. A shaft extends along the ladder and through the bearings and the housing, the cutter head coupled to a distal end of the shaft.

20 Claims, 4 Drawing Sheets

CUTTER THRUST BEARING ASSEMBLY

BACKGROUND

Cutter suction dredgers (CSDs) are floating vessels (boats, barges, etc.) with tools that are used to dredge the beds of rivers, lakes, and other bodies of water. CSDs use a rotating cutter head at the end of an elongated structure called a ladder to break up sand, rock, dirt, and gravel. The material broken up by the cutter head is sucked into a suction conduit and transported up the ladder to the vessel. The material can then be transported away to a dumping site.

A motor is coupled to and is configured to rotate the cutter head via a shaft that runs through the ladder. When the cutter head is in use, the shaft experiences radial forces and thrust forces due to the angle of the ladder. Bearings can be used to react the forces to protect the shaft and motor.

SUMMARY OF TIE INVENTION

In one set of embodiments, a cutter suction dredger includes a vessel configured to float on water, a ladder extending away from the vessel, the ladder comprising a proximal end coupled to the vessel and a distal end configured to be raised and lowered, a cutter head positioned at the distal end of the ladder and configured to contact a bed of a body of water to cut into and break up the bed, and a bearing assembly. The bearing assembly includes a first spherical thrust bearing configured to resist thrust forces generated by the cutter head contacting the bed of the body of water, a second spherical thrust bearing positioned opposite the first spherical thrust bearing, a symmetrical spherical bearing positioned between the first spherical thrust bearing and the second spherical thrust bearing, and a housing surrounding the first spherical thrust bearing, the second spherical thrust bearing, and the symmetrical spherical bearing, the housing mounted to the ladder. The cutter suction dredger further includes a shaft extending along the ladder and through the first spherical thrust bearing, the second spherical thrust bearing, the symmetrical spherical bearing, and the housing, the cutter head coupled to a distal end of the shaft.

In another set of embodiments, a dredging assembly includes a cutter head coupled to a shaft, the cutter head configured to be pressed, by the shaft, into a bed of a body of water to cut into and break up the bed and a bearing assembly rotatably supporting the shaft. The bearing assembly includes a first spherical thrust bearing that receives the shaft and is configured to resist thrust forces generated by the cutter head contacting the bed of the body of water, a second spherical thrust bearing positioned opposite the first spherical thrust bearing, a symmetrical spherical bearing positioned between the first spherical thrust bearing and the second spherical thrust bearing, and a housing surrounding the first spherical thrust bearing, the second spherical thrust bearing, and the symmetrical spherical bearing, the housing configured to be mounted to a ladder of a cutter suction dredger.

It will be recognized that the Figures are the schematic representations for purposes of illustration. The Figures are provided for the purpose of illustrating one or more implementations with the explicit understanding that the Figures will not be used to limit the scope of the meaning of the claims.

DETAILED DESCRIPTION

Figure 1:
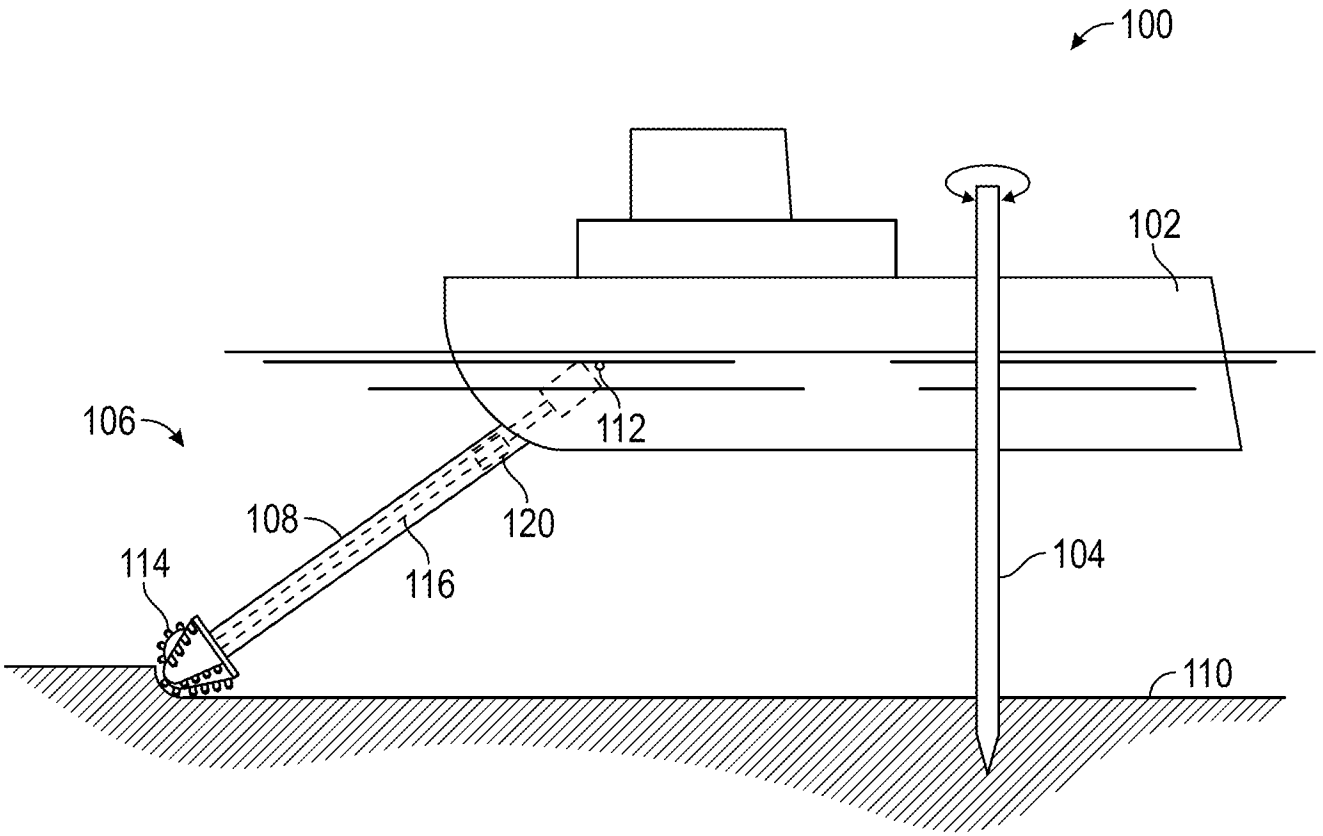
FIG. 1 is a side view of a cutter suction dredger, according to an exemplary embodiment.

Referring to FIG. 1, a side view of a cutter suction dredger 100 is shown, according to an exemplary embodiment. The cutter suction dredger 100 incudes a vessel 102 (e.g., a boat, a barge, etc.) and may include at least one spud post 104 for anchoring the vessel 102 to the bed 110 (e.g., seabed, lakebed, riverbed of the body of water on which the vessel 102 floats. In some embodiments, the vessel 102 may be coupled to a pontoon that includes a spud post. The cutter suction dredger 100 includes a dredging assembly 106. The dredging assembly 106 includes a ladder 108 that extends away from the vessel 102. The ladder 108 may be, for example, a weldment configured to support or house other components of the dredging assembly 106. The ladder is rotatable about a point 112 such that the end of the ladder can be raised and lowered. The ladder can extend from the vessel 102 to the bed 110, depending on the depth of the water.

A cutter head 114 is positioned at the end of the ladder 108. The cutter head 114 is coupled to a shaft 116 that runs along or runs through the inside of the ladder 108 to a motor 118. The motor 118 may be positioned in the vessel or may be positioned in the ladder 108 near the cutter head 114. The motor 118 is configured to rotate the shaft 116 and the cutter head 114. The rotating cutter head 114 contacts and is pressed into the bed 110 to cut into and break up the materials of the bed 110. A bearing assembly 120 is positioned in the ladder 108 near the cutter head 114 to react the radial and thrust forces resulting from pressing the cutter head 114 into the bed 110. In some embodiments, the cutter suction dredger 100 may include multiple motors 118 coupled to a gearbox to rotate the shaft 116. The shaft 116 may comprise multiple sections, for example, multiple sections joined at their respective ends by couplings.

Various conventional bearing assemblies include a radial bearing sandwiched between two cylindrical roller thrust bearings. While the cylindrical roller thrust bearings include a spherical washer to account for misalignment between the shaft 116 and the bearings, the spherical washers typically do not share a common pivot point. The loading can become unbalanced and the spherical surfaces can experience non-uniform contact, causing unequal loading and added stress. The radial bearing can also experience a non-uniform load distribution. The bearings are typically lubricated with grease, which, in addition to the misalignment, can cause the bearing to operate in the boundary lubrication condition rather than the hydrodynamic lubrication condition.

Figure 2:
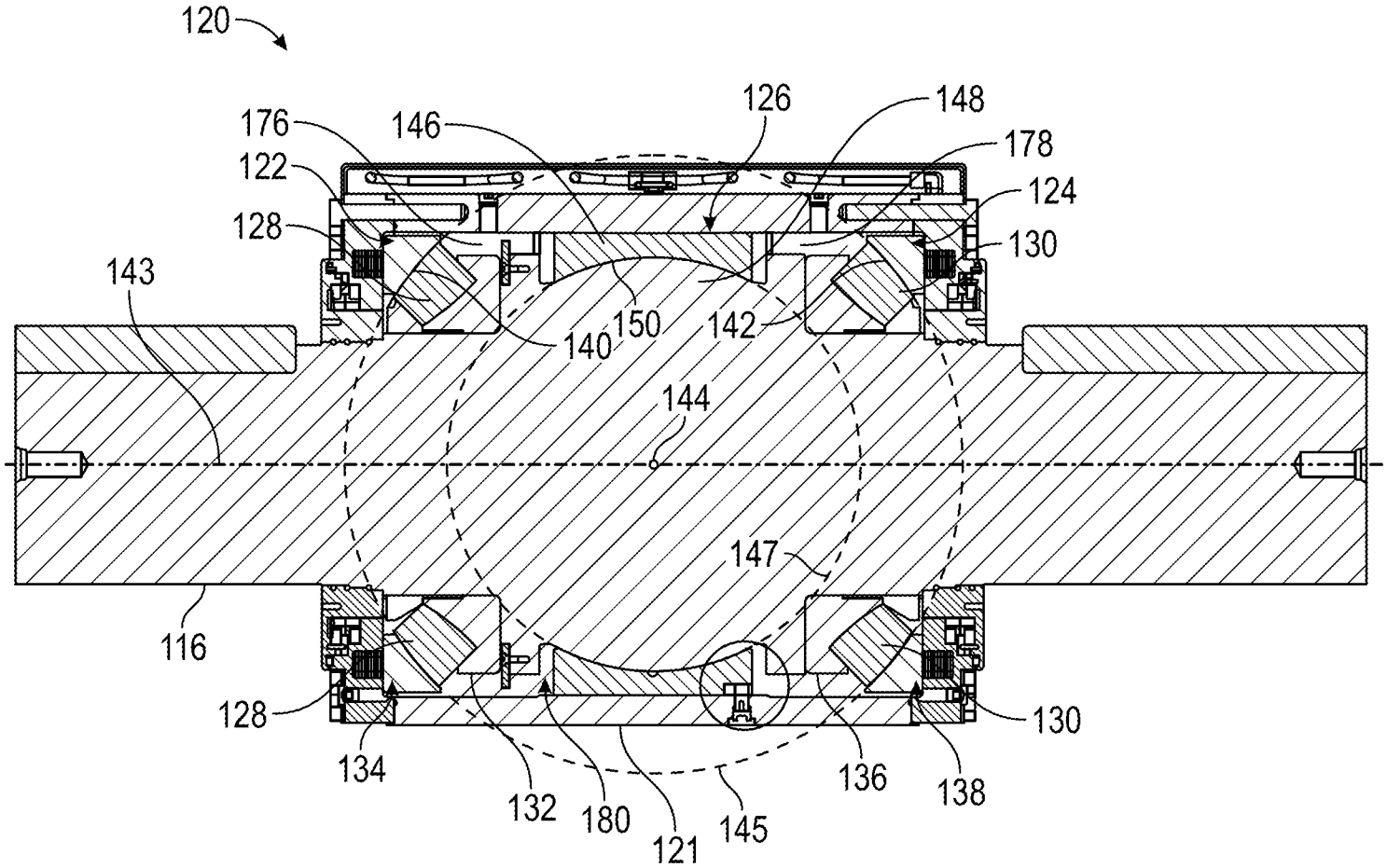
FIG. 2 is a cross-sectional view of a bearing assembly of the cutter suction dredger of FIG. 1.

Referring to FIG. 2, a cross-sectional view of an example bearing assembly 120 of the cutter suction dredger 100 is shown. The bearing assembly 120 includes a first spherical roller thrust bearing 122, a second spherical roller thrust bearing 124, and a symmetrical spherical bearing 126 positioned (e.g., a symmetrical spherical plain bearing, a symmetrical spherical roller bearing, etc.) within a housing 121. The shaft 116 of the dredging assembly 106 passes through the center the first spherical roller thrust bearing 122, the center of the symmetrical spherical bearing 126, and the center of the second spherical roller thrust bearing 124 along a common axis of rotation 143, which allows the shaft to rotate relative to the housing 121. The first spherical roller thrust bearing 122 includes a first plurality of asymmetrical rollers 128 positioned between a first outer raceway 132 (e.g., an outer race) and a first inner raceway 136 (e.g., an inner race). The second spherical roller thrust bearing 124 includes a second plurality of asymmetrical rollers 130 positioned between a second outer raceway 134 and a second inner raceway 138. It should be understood that the each of the first plurality of asymmetrical rollers 128 and each of the second plurality of asymmetrical rollers 130 are symmetrical about their respective axes of rotation and asymmetrical about any plane that is not coincident with the axis of rotation.

The first outer raceway 132 includes a first spherical surface 140 on which the first plurality of asymmetrical rollers 128 roll to allow rotation of the first inner raceway 136, as well as the shaft 116, relative to the first outer raceway 132. The second outer raceway 134 includes a second spherical surface 142 on which the second plurality of asymmetrical rollers 130 roll to allow rotation of the second inner raceway 138, as well as the shaft 116, relative to the second outer raceway 134.

The center point of a sphere coincident with the spherical surface of the outer race of a spherical roller bearing is called the pressure point of the bearing. Any line normal to the spherical surface of the outer race passes through the pressure point. The first spherical thrust bearing 122 and the second spherical thrust bearing 124 are positioned such that the pressure point of the first spherical thrust bearing 122 is substantially coincident with the pressure point of the second spherical thrust bearing 124. Thus, a center of a sphere coincident with the first spherical surface 140 and the center of a sphere coincident with the second spherical surface 142 are located at approximately the same point 144 on the common axis of rotation 143. In these positions and with the first spherical thrust bearing 122 being the same size as the second spherical thrust bearing 124, a single sphere (e.g., sphere 145) can be coincident with the first spherical surface 140 and the second spherical surface 142. With the first spherical thrust bearing 122 and the second spherical thrust bearing 124 having substantially coincident pressure points, angular misalignment between the housing 121 and shaft 116 simply displaces the first plurality of asymmetrical rollers 128 relative to the first inner race 132 and the first outer race 136 and the second plurality of asymmetrical rollers 130 relative to the second inner race 134 and the second outer race 138 without introducing any load non-uniformity or loss of contact. The first spherical thrust bearing 122 is configured to resist thrust forces in a first direction (e.g., to the left of FIG. 2 as shown) and the second spherical thrust bearing 124 is configured to resist thrust in the opposite direction (e.g., to the right of FIG. 2 as shown). The first spherical thrust bearing 122 may resist thrust forces generated by the cutter head 114 contacting and being pressed into the bed of the body of water. The second spherical thrust bearing 124 is positioned and oriented in the opposite direction of the first spherical thrust bearing 122 and may resist, for example, gravitational forces on the shaft 116.

The symmetrical spherical bearing 126 has an outer race 146 and an inner race 148. The outer race 146 has a spherical surface 150 with which the inner race 148 is in sliding contact, to allow rotation of the inner race 148 relative to the outer race 146. The symmetrical spherical bearing 126 is positioned such that the center of a sphere (e.g., sphere 147) coincident with the spherical surface 150 is located at approximately a point 144. This point may be referred to as the center point of the symmetrical spherical bearing 126. Thus, the center point of the symmetrical spherical bearing 126 may be substantially coincident with the pressure points of the first spherical thrust bearing 122 and the second spherical thrust bearing 124. The first spherical roller thrust bearing 122, the second spherical roller thrust bearing 124, and the symmetrical spherical bearing 126 all share a common pivot point, the point 144, and the entire assembly operates uniformly when there is alignment error between the shaft centerline and the housing center line.

Figure 3:
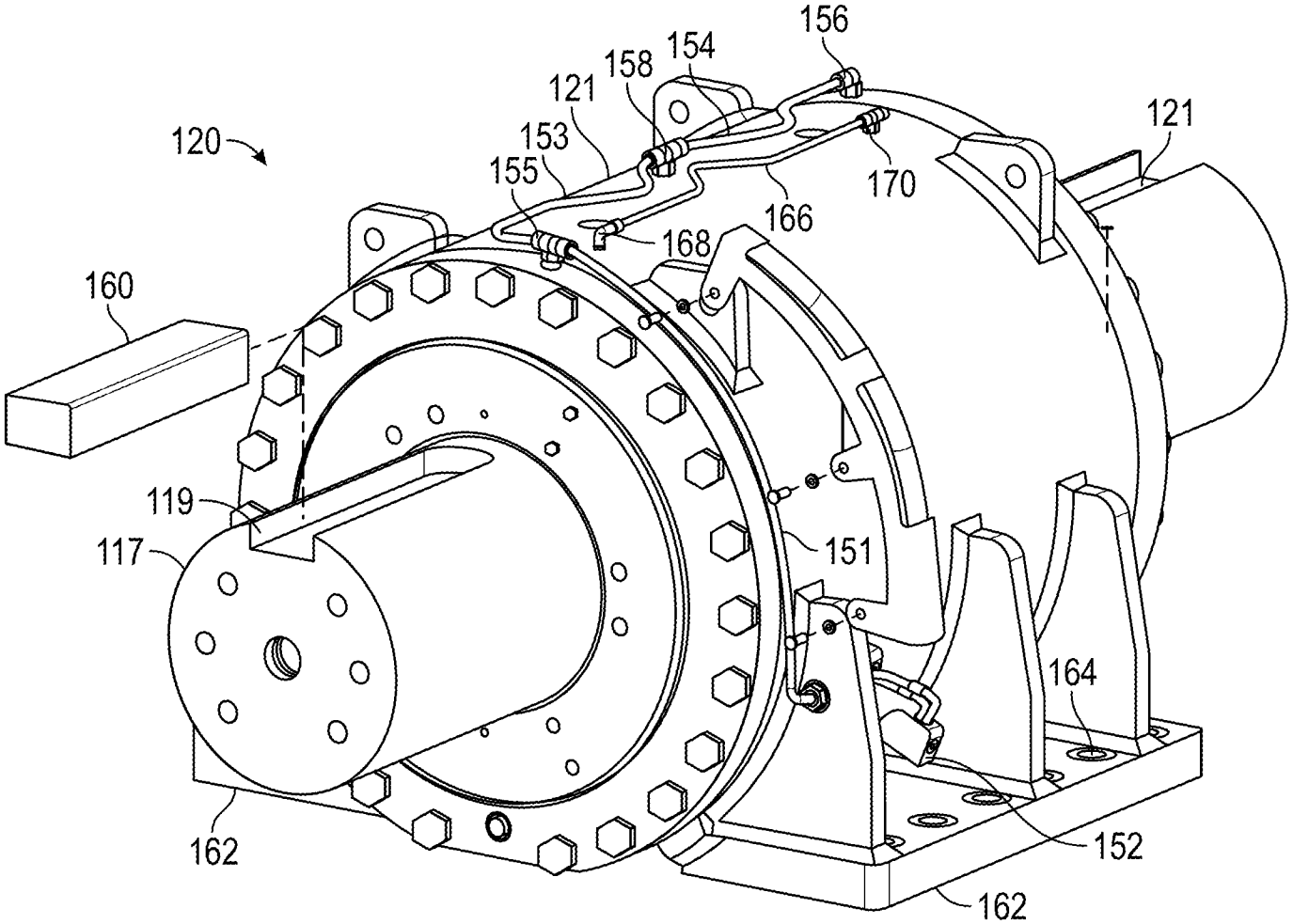
FIG. 3 is a perspective view of the bearing assembly of FIG. 2.

The bearing assembly 120 can be lubricated with a fluid or semifluid lubricant rather than grease. This may allow the symmetrical spherical bearing 126 to operate in the hydrodynamic lubrication condition. Referring now to FIG. 3, a perspective view of the bearing assembly 120 is shown. The bearing assembly 120 includes a lubricant pump 152 mounted to the housing 121 near the bottom of the bearing assembly 120. The lubricant pump 152 is configured to pump lubricant from the bottom of an inner cavity 180 of the bearing assembly 120 to the top of the inner cavity via a first lubricant conduit 151, a second lubricant conduit 153, and a third lubricant conduit 154. The pump 152, the first lubricant conduit 151, the second lubricant conduit 153, and the third lubricant conduit 154 may be mounted to the outside of the housing or may be positioned inside or integrated with the housing. Lubricant is supplied to the top of the first spherical thrust bearing 122 and the second spherical thrust bearing 124 via a first lubricant fitting 155, and a second lubricant fitting 156 and to the top of the symmetrical spherical bearing 126 via a third lubricant fitting 158. The first lubricant fitting 155, the second lubricant fitting 156, and the third lubricant fitting 158 may be fluidly coupled to sprayers configured to distribute the lubricant.

Referring still to FIG. 3, the bearing assembly 120 includes a flange 162 with a plurality of openings 164 on each side of the housing 121 for mounting to the ladder 108. A shaft portion 117 of the shaft 116 extends through the housing 121 and out of openings at each end of the housing 121. The shaft portion 117 includes a keyway 119 at a first end thereof and a keyway 123 at a second end thereof, each configured to receive a key, for example, key 160. The shaft portion 117 may be received by a coupling with a corresponding keyway, and the coupling may couple the shaft portion to additional shaft portions. For example, the first end of the shaft portion 117 (e.g., including the keyway 119) may be coupled to a cutter head. The second end of the shaft portion 117 (e.g., including the keyway 123) may be coupled to a second shaft portion that is coupled to a motor or a gearbox coupled to one or more motors. Dividing the shaft 116 into various portions allows for easier manufacturing of the shaft 116 and easier assembly and transportation of the various subassemblies of the cutter suction dredger 100. The couplings may allow a step up or step down in shaft diameter according to the mechanical requirements of the shaft 116 in different locations.

Referring still to FIG. 3, the bearing assembly 120 includes an air conduit 166 coupled to a first fitting 168 and a second fitting 170. The first fitting 168 is fluidly coupled to a first portion 176 of an inner cavity 180 of the housing 121. The second fitting 170 is fluidly coupled to a second portion 178 of the inner cavity 180 of the housing 121. The first portion 176 and the second portion 178 of the inner cavity 180 are separated by the symmetrical spherical bearing 126 and are fluidly coupled by the air conduit 166. The inner cavity 180 may not be completely filled with liquid lubricant and may include a volume of air. The second fitting 170 is configured to be fluidly coupled to a second air conduit that extends up the ladder 108 towards the vessel 102 and is connected to a source of compressed air (e.g., a pump, a pressure vessel, etc.). When the cutter suction dredger 100 is in use, the bearing assembly 120 may be fully or partially submerged under water, thus subjecting the outside of the bearing assembly 120 to increased pressure. Pressurized air may be supplied to the air conduit 166 to increase the pressure in the inner cavity 180 and equalize the pressure on the inside and the outside of the housing 121. When the ladder 108 is raised, the water pressure on the outside of the bearing assembly 120 decreases, resulting in the pressure in the inner cavity 180 exceeding the pressure acting on the outside of the bearing assembly 120. Air can be allowed to flow out of the inner cavity 180 via the air conduit 166 to equalize the pressure again. The pressure in the first portion 176 and the second portion 178 of the inner cavity 180 can also be equalized because they are fluidly coupled by the air conduit 166. A controller may be configured to determine the pressure acting on the outside of the bearing assembly 120 and to control the air pressure in the inner cavity 180 accordingly. For example, the controller may receive pressure data from a pressure sensor coupled to the bearing assembly 120 or may estimate the pressure based on the angle of the ladder 108 and may open or close valves to allow air to flow into or out of the inner cavity 180.

Figure 4:
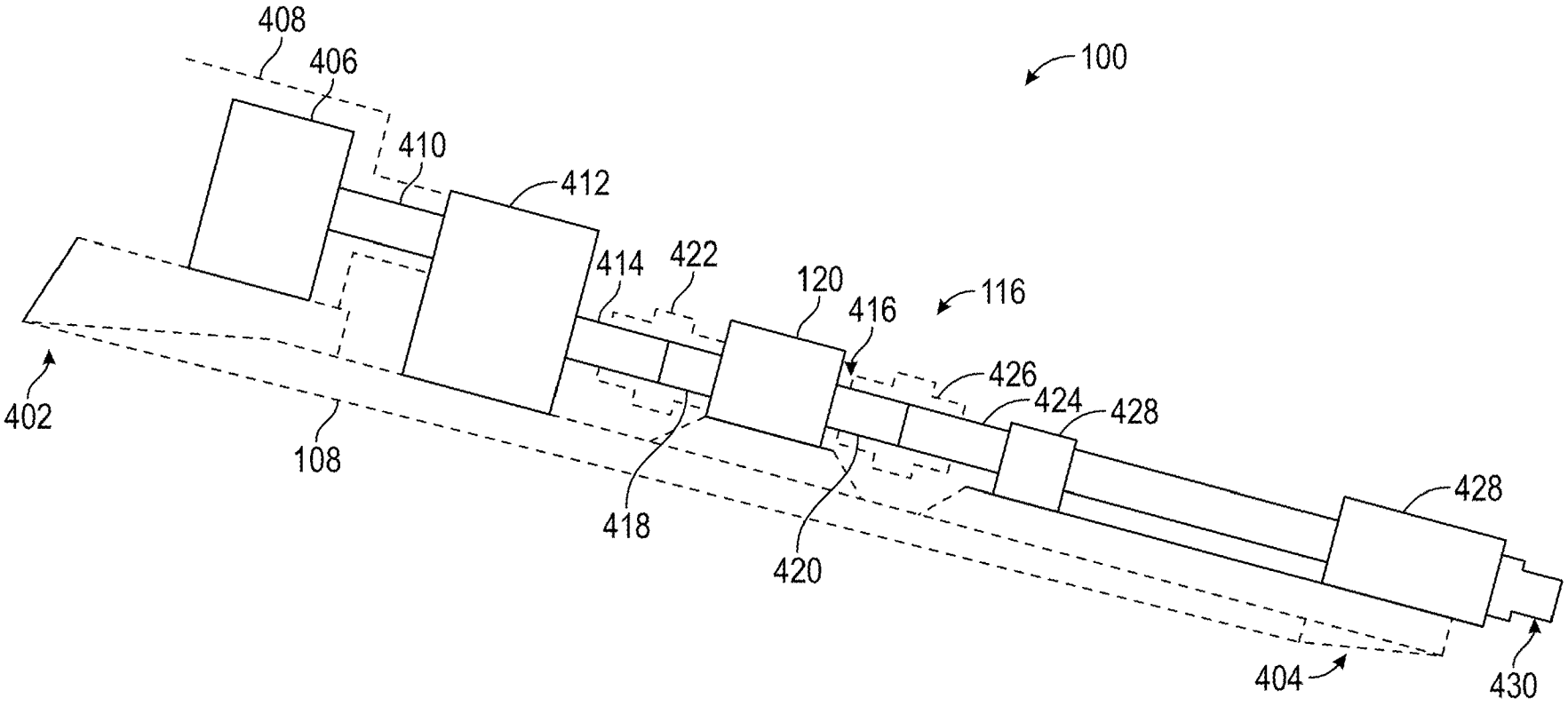
FIG. 4 is a side view of a portion of a cutter suction dredger 100 is shown, according to an exemplary embodiment.

Referring now to FIG. 4, a side view of portion of a cutter suction dredger 100 is shown, according to an exemplary embodiment. Portions illustrated with dashed lines are shown in cross-section, for clarity. The ladder 108 extends from a proximal end 402 coupled to the vessel 102 (not shown) to a distal end 404. A motor 406 is coupled to the ladder 108 near the proximal end 402. The motor 406 may be contained within a housing 408 to keep water and other environmental debris away from the motor 406. The motor shaft 410 of the motor 406 is coupled to a gearbox 412 coupled to the ladder 108 at a position distal to the motor 406. The gearbox 412 is coupled to an output shaft 414 (e.g., a second portion of shaft 116). Thus the gearbox couples the motor 406 to the shaft 116 so that the motor 406 rotates the shaft 116. The gearbox 412 may be configured to receive the input rotational speed and torque from the motor shaft 410 and to rotate the output shaft 414 at a lower rotational speed and higher torque. In some embodiments, multiple motors 406 may be coupled to the gearbox 412 to cooperatively increase the torque output.

The bearing assembly 120 is coupled to the ladder 108 at a position distal to the gearbox 412. The output shaft 414 is coupled to a first end 418 of a portion of the shaft 116 that extends through the bearing assembly 120 (e.g., a first portion 416 of the shaft 116) by a first shaft coupling 422. A second end 420 of the first portion 416 of the shaft 116 is coupled to a third portion 424 of the shaft 116 by a second shaft coupling 426. The third portion 424 of the shaft 116 extends to the distal end 404 of the ladder 108. The third portion 424 may extend through one or more additional bearing assemblies 428 coupled to the ladder 108, and may include or be coupled to a distal portion 430 configured to receive a cutter head that dredges the bed of a body of water.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the cutter suction dredger 100 and the systems and components thereof as shown in the various exemplary embodiments is illustrative only. Additionally, any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A cutter suction dredger comprising:

a vessel configured to float on water, a ladder extending away from the vessel, the ladder comprising a proximal end coupled to the vessel and a distal end configured to be raised and lowered;

a cutter head positioned at the distal end of the ladder and configured to contact a bed of a body of water to cut into and break up the bed;

a bearing assembly comprising:

a first spherical thrust bearing configured to resist thrust forces generated by the cutter head contacting the bed of the body of water;

a second spherical thrust bearing positioned opposite the first spherical thrust bearing;

a symmetrical spherical bearing positioned between the first spherical thrust bearing and the second spherical thrust bearing; and a housing surrounding the first spherical thrust bearing, the second spherical thrust bearing, and the symmetrical spherical bearing, the housing mounted to the ladder; and a shaft extending along the ladder and through the first spherical thrust bearing, the second spherical thrust bearing, the symmetrical spherical bearing, and the housing, the cutter head coupled to a distal end of the shaft, wherein the cutter suction dredger does not include a cylindrical radial bearing coupling the bearing assembly housing to the shaft.

2. The cutter suction dredger of claim 1, wherein the first spherical thrust bearing has a pressure point that is substantially coincident with a pressure point of the second spherical thrust bearing.

3. The cutter suction dredger of claim 2, wherein the first spherical thrust bearing includes a first outer race and the second spherical thrust bearing includes a second outer race, a surface of a sphere coincident with an inner surface of the first outer race being coincident with an inner surface of the second outer race.

4. The cutter suction dredger of claim 2, wherein a center point of the symmetrical spherical bearing is substantially coincident with the pressure points of the first and second spherical bearings.

5. The cutter suction dredger of claim 4, wherein the first spherical thrust bearing, the second spherical thrust bearing, and the symmetrical spherical bearing share a common axis that passes through the center point, and the shaft extending along the common axis.

6. The cutter suction dredger of claim 1, wherein a first portion of the shaft extends through the bearing assembly, is coupled at a first end to a second portion of the shaft via a first shaft coupling, and is coupled at a second end to a third portion of the shaft via a second shaft coupling.

7. The cutter suction dredger of claim 6, wherein the second portion of the shaft is coupled to a motor configured to rotate the shaft and the third portion of the shaft is coupled to the cutter head.

8. The cutter suction dredger of claim 1, further comprising a source of compressed air, the source of compressed air fluidly coupled to an inner cavity of the housing and configured to supply compressed air to the inner cavity when the bearing assembly is submerged under water.

9. The cutter suction dredger of claim 8, wherein the source of compressed air is a pump positioned proximate the proximal end of the ladder and the pump is fluidly coupled to the inner cavity via one or more conduits.

10. The cutter suction dredger of claim 9, wherein one of the one or more conduits fluidly couples a first portion of the inner cavity to a second portion of the inner cavity, the first and second portions of the inner cavity separated by the symmetrical spherical bearing.

11. A dredging assembly comprising:

a cutter head coupled to a shaft, the cutter head configured to be pressed, by the shaft, into a bed of a body of water to cut into and break up the bed; and a bearing assembly rotatably supporting the shaft, the bearing assembly comprising:

a first spherical thrust bearing that receives the shaft and is configured to resist thrust forces generated by the cutter head contacting the bed of the body of water;

a second spherical thrust bearing positioned opposite the first spherical thrust bearing;

a symmetrical spherical bearing positioned between the first spherical thrust bearing and the second spherical thrust bearing; and a housing surrounding the first spherical thrust bearing, the second spherical thrust bearing, and the symmetrical spherical bearing, the housing configured to be mounted to a ladder of a cutter suction dredger, wherein the dredging assembly does not include a cylindrical radial bearing coupling the bearing assembly housing to the shaft.

12. The dredging assembly of claim 11, wherein the first spherical thrust bearing has a pressure point that is substantially coincident with a pressure point of the second spherical thrust bearing.

13. The dredging assembly of claim 12, wherein the first spherical thrust bearing includes a first outer race and the second spherical thrust bearing includes a second outer race, a surface of a sphere coincident with an inner surface of the first outer race being coincident with an inner surface of the second outer race.

14. The dredging assembly of claim 12, wherein a center point of the symmetrical spherical bearing is substantially coincident with the pressure points of the first and second spherical bearings.

15. The dredging assembly of claim 14, the first spherical thrust bearing, the second spherical thrust bearing, and the symmetrical spherical bearing sharing a common axis of rotation that passes through the center point, and wherein the first spherical thrust bearing, the second spherical thrust bearing, and the symmetrical spherical bearing are configured to receive a cutter shaft of the cutter suction dredger along the common axis.

16. The dredging assembly of claim 11, wherein the symmetrical spherical bearing is a spherical plain bearing.

17. The dredging assembly of claim 11, further comprising a lubricant pump configured to pump lubricant from the bottom of an inner cavity of the bearing assembly to the top of the inner cavity.

18. The dredging assembly of claim 17, wherein the lubricant pump is mounted to the outside of the housing and pumps lubricant to the top of the inner cavity via a lubricant conduit positioned outside the housing.

19. The dredging assembly of claim 17, wherein the lubricant is a fluid or semifluid lubricant.

20. The dredging assembly of claim 11, further comprising an air conduit fluidly coupled to a first portion and a second portion of an inner cavity of the housing, the first and second portions separated by the symmetrical spherical bearing, wherein the air conduit is configured to be fluidly coupled to a source of pressurized air to pressurize the inner cavity when the bearing assembly is submerged under water.

* * * * *